US010344428B2

(12) United States Patent
Mohammadi et al.

(10) Patent No.: US 10,344,428 B2
(45) Date of Patent: Jul. 9, 2019

(54) PROCESS FOR INDIVIDUALIZING TRICHOMES

(71) Applicant: The Procter & Gamble Company, Cincinnati, OH (US)

(72) Inventors: Khosrow Parviz Mohammadi, Liberty Township, OH (US); Freddy Arthur Barnabas, West Chester, OH (US); Bryan Keith Waye, Mason, OH (US); Douglas Michael Graham, Cincinnati, OH (US); Raul Victorino Nunes, Loveland, OH (US); Mark Lewis Agerton, Mason, OH (US); Kassandra Natale Diazrivera, Albany, NY (US); Alan Howard Ullman, Blue Ash, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 142 days.

(21) Appl. No.: 15/602,187

(22) Filed: May 23, 2017

(65) Prior Publication Data

US 2017/0335512 A1 Nov. 23, 2017

Related U.S. Application Data

(60) Provisional application No. 62/340,189, filed on May 23, 2016.

(51) Int. Cl.
*D21C 3/00* (2006.01)
*D21C 1/10* (2006.01)
(Continued)

(52) U.S. Cl.
CPC ..... *D21C 3/003* (2013.01); *D21B 1/021* (2013.01); *D21C 1/10* (2013.01); *D21C 5/00* (2013.01);
(Continued)

(58) Field of Classification Search
None
See application file for complete search history.

(56) References Cited

U.S. PATENT DOCUMENTS 5,772,847 A 6/1998 Simpson et al.
9,718,065 B1 * 8/2017 Cilia ..... B03B 5/28
(Continued)

FOREIGN PATENT DOCUMENTS

WO WO-2004044320 A2 * 5/2004 ..... B32B 23/10
WO WO02006137041 A2 * 12/2006
(Continued)

OTHER PUBLICATIONS

Zhang, et al., "A Simple and Efficient Method for Isolating Trichomes for Downstream Analyses", Plant and Cell Phys., v 45, No. 2, pp. 221-224. (Year: 2004).*
(Continued)

*Primary Examiner* — Dennis R Cordray
(74) *Attorney, Agent, or Firm* — Andrew J. Mueller

(57) ABSTRACT

A process for individualizing (separating) trichome fibers from a trichome source, such as a leaf and/or a stem, and more particularly to a process for individualizing (separating) trichome fibers from a trichome source utilizing a chemical separation process are provided.

19 Claims, 8 Drawing Sheets

(51) Int. Cl.

| | |
|---|---|
| ***D21B 1/02*** | (2006.01) |
| ***D21C 5/00*** | (2006.01) |
| ***D21H 27/00*** | (2006.01) |
| ***D21C 9/10*** | (2006.01) |
| ***D21H 11/12*** | (2006.01) |
| ***D21H 17/15*** | (2006.01) |
| ***D21H 21/22*** | (2006.01) |

(52) U.S. Cl.
CPC ..... *D21C 9/1042* (2013.01); *D21H 11/12* (2013.01); *D21H 17/15* (2013.01); *D21H 21/22* (2013.01); *D21H 27/002* (2013.01)

(56) References Cited

U.S. PATENT DOCUMENTS

| | | | | |
|---|---|---|---|---|
| 2004/0221975 | A1 | 11/2004 | Hernandez-Munoa et al. | |
| 2004/0250969 | A1* | 12/2004 | Luu | B32B 23/10 162/123 |
| 2006/0260002 | A1* | 11/2006 | Ronen | C07K 14/565 800/278 |
| 2006/0288639 | A1 | 12/2006 | Vinson et al. | |
| 2007/0011762 | A1 | 1/2007 | Vinson et al. | |
| 2009/0054858 | A1 | 2/2009 | Cheng et al. | |
| 2009/0084513 | A1 | 4/2009 | Barnholtz et al. | |
| 2010/0239843 | A1 | 9/2010 | Luu et al. | |
| 2011/0104419 | A1 | 5/2011 | Barnholtz et al. | |
| 2011/0168342 | A1 | 7/2011 | Mohammadi | |
| 2015/0176216 | A1 | 6/2015 | Ostendorf et al. | |
| 2015/0337496 | A1 | 11/2015 | Lee | |

FOREIGN PATENT DOCUMENTS

| | | | | |
|---|---|---|---|---|
| WO | WO-2009024897 | A2 * | 2/2009 | D21H 11/12 |
| WO | WO-2011053956 | A1 * | 5/2011 | |

OTHER PUBLICATIONS

U.S. Appl. No. 14/963,278, filed Dec. 9, 2015, Mohammadi, et al.
U.S. Appl. No. 15/378,430, filed Dec. 14, 2016, Mohammadi, et al.
U.S. Appl. No. 15/378,627, filed Dec. 14, 2016, Mohammadi, et al.
PCT International Search Report dated Feb. 10, 2017—4 pages.
PCT International Search Report dated Jul. 20, 2017—6 pages.
PCT International Search Report dated Jul. 20, 2017—5 pages.
All Office Actions U.S. Appl. No. 14/963,278.
All Office Actions U.S. Appl. No. 15/378,627.
All Office Actions U.S. Appl. No. 15/378,430.
All Office Actions U.S. Appl. No. 15/602,187.

* cited by examiner

PROCESS FOR INDIVIDUALIZING TRICHOMES

FIELD OF THE INVENTION

The present invention relates to a process for individualizing (separating) trichome fibers from a trichome source, such as a leaf and/or a stem, and more particularly to a process for individualizing (separating) trichome fibers from a trichome source utilizing a chemical separation process.

BACKGROUND OF THE INVENTION

The interest in using non-wood materials, such as trichomes and bamboo fibers, to make fibrous structures, for example sanitary tissue products, has recently increased in light of the continuing efforts relating to sustainability.

One non-wood material that shows promise as a replacement or partial replacement of wood pulp fibers in fibrous structures, such as sanitary tissue products, is trichomes; namely, individualized trichome fibers obtained from plants, such as *Stachys byzantina* plants, for example Lamb's Ear plants. However, "clean" individualized trichome fibers are challenging to obtain in large amounts due to the impurities, such as stems, specks, dirt, clay, sand, and other non-trichome materials that are present with the individualized trichome fibers as a result of the processes for harvesting and extracting the individualized trichome fibers from the plants. These impurities find their way into fibrous structures made with the individualized trichome fibers and result in the fibrous structures looking dirty and filled with specks that render the fibrous structures unacceptable to consumers of the fibrous structures.

Known processes for individualizing (separating) trichome fibers from plants typically utilize mechanical cutting and air sorting operations. Such operations are very costly, require high amounts of maintenance, are normally batch processes rather than continuous processes, and the individualized trichome fibers still contain a level of non-trichome materials, for example specks, sand, stems, that is not consumer acceptable.

Processes for isolating trichome fibers from trichome sources are known in the art. For example, mechanical processes for isolating (individualizing) trichome fibers from trichome sources to obtain individualized trichome fibers are known. However, such mechanical processes result in the individualized trichome fibers containing undesirable contaminants, such as dirt, fines, and non-trichome materials, such as parts of leaves and/or stems.

In addition, known benchtop scale chemical separation processes for removing trichomes, for example *Arabidopsis* trichomes from the Brassicaceae family, from trichome sources are known. Such a known benchtop scale chemical separation process utilizes a mixture of a chelating agent, such as ethylene glycol bis-(β-aminoethyle ether)-N,N,N',N'-tetraacetic acid ("EGTA") and a nonionic surfactant, such as Triton X-100. The process incubates the trichome source in a mixture of EGTA and Triton X-100 at 4° C. for 16-24 hours and/or at 50° C. for 1 hour followed by gentle rubbing using an artist's paintbrush. Such as process is not commercially feasible on a large scale commercial process. Nor are the *Arabidopsis* trichomes considered trichome fibers in accordance with the present invention in light of their thorny structure as shown in Prior Art FIG. 1. Such a thorny trichome would not be suitable for use in sanitary tissue products, such as bath/toilet tissue, unlike the non-thorny trichome fibers, especially the trichome fibers from the Labiatae family.

One problem with known processes for individualizing trichome fibers from trichome sources (for example plants) is the inability to remove non-trichome materials (impurities present in the plants and/or growing environments from which the plants are harvested) cost effectively and/or in a continuous process such that the individualized trichomes contain no or a consumer acceptable level of non-trichome materials so that the individualized trichome fibers may ultimately be used to make consumer desirable fibrous structures for sanitary tissue products. Further, known processes result in contaminated individualized trichome fibers and/or low yields and/or are not commercially feasible on a large scale, for example using an artist's paintbrush to rub the trichome source to cause the trichomes to separate from the trichome source is not a cost-effective, commercially viable step in a process for removing trichomes from a trichome source.

Accordingly, there is a need for a process that is able to individualize trichome fibers from trichome sources (for example plants) in a cost effective, low maintenance, continuous process that results in the individualized trichome fibers having no or a consumer acceptable level of non-trichome materials (impurities present in the plants and/or growing environments from which the plants are harvested) such that the individualized trichome fibers can be used to make consumer desirable fibrous structures, such as sanitary tissue products.

SUMMARY OF THE INVENTION

The present invention fulfills the need described above by providing a commercially viable process for individualizing trichome fibers from a trichome source.

One solution to the problem identified above is to use a process for individualizing trichome fibers from trichome sources that utilizes a chelating composition comprising a chelating agent and a surfactant in the presence of heat (temperatures greater than 60° C. and/or greater than 70° C. and/or greater than 80° C. and/or greater than 90° C. and/or greater than 100° C. to less than the charring temperature of the trichome fiber and/or trichome source, whichever is lower and/or less than 400° C. and/or less than 300° C. and/or less than 200° C.), and optionally, pressure (greater than 5 psi and/or greater than 10 psi and/or greater than 20 psi to about 80 psi and/or to about 60 psi and/or to about 50 psi and/or to about 40 psi) and moisture, for example in the presence of steam and/or pressure.

In one example of the present invention, a process for individualizing a trichome fiber from a trichome source comprising the steps of:

a. contacting a trichome source with a chelating composition comprising a chelating agent and a surfactant to produce a soaked trichome source, for example contacting a trichome source with a level of chelating composition such that the soaked trichome source is a saturated trichome source and/or for example contacting a trichome source for at least 1 and/or at least 2 and/or at least 3 and/or at least 4 and/or at least 5 minutes;
b. subjecting the soaked trichome source to a temperature of greater than 60° C. and/or for example for at least 5 and/or at least 10 and/or at least 15 and/or at least 20 minutes; and c. removing one or more individualized trichome fibers from the soaked trichome source, is provided.

In another example, a fibrous structure, such as a sanitary tissue product, comprising a plurality of individualized trichome fibers obtained from the process according to the present invention, is provided.

The present invention provides a process for individualizing trichome fibers from a trichome source, wherein the process overcomes the negatives associated with known process for removing trichome fibers from trichome sources.

DETAILED DESCRIPTION OF THE INVENTION

Definitions

Figure 1:
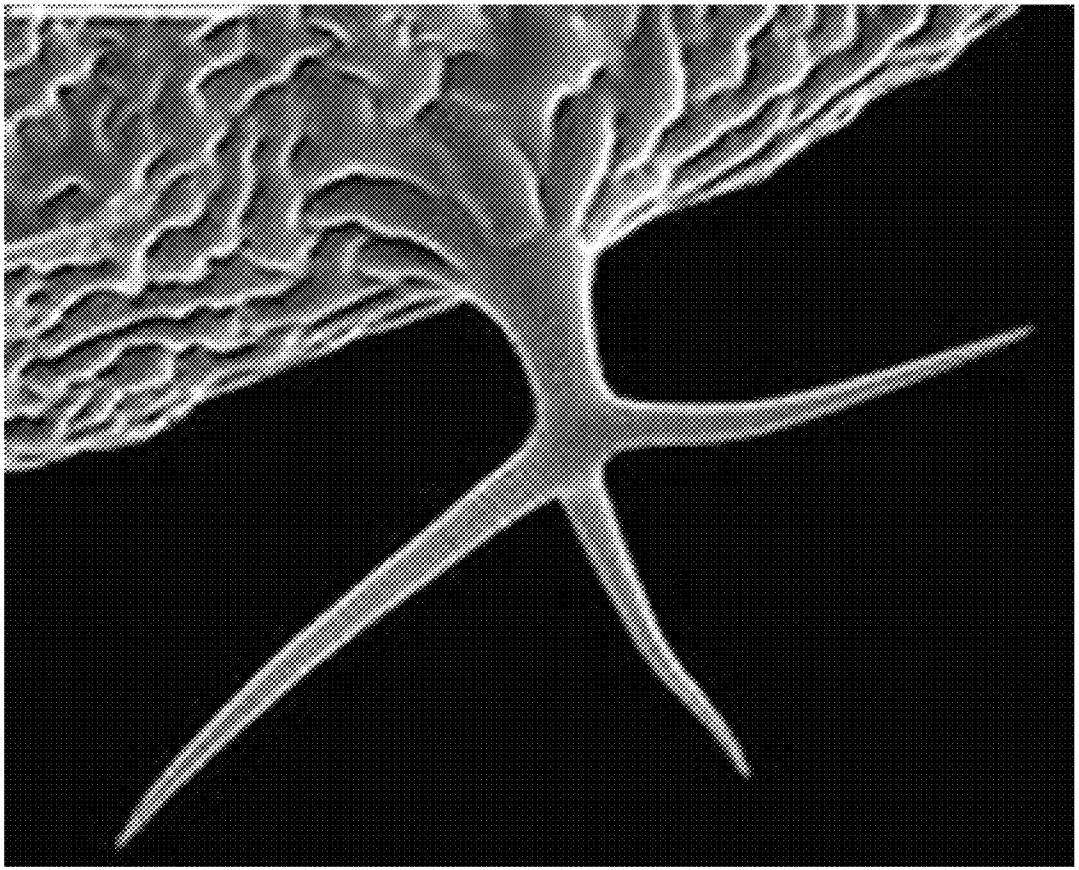
Fig. 1 PRIOR ART
FIG. 1 is an image of a prior art *Arabidopsis* trichome illustrating its thorny structure.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture.

A trichome may be formed by one cell or many cells.

The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. "Individualized trichome fiber" as used herein means individualized trichomes that are suitable for use in fibrous structures, such as sanitary tissue products, and do not exhibit a thorny structure like the *Arabidopsis* trichome.

In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials includes non-trichome-bearing fragments of the host plant.

In one example of the present invention, the individualized trichomes may be classified to enrich the individualized trichomal content at the expense of mass not constituting individualized trichomes.

Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant. However, such monocotyledonous plant derived fibers may be present in fibrous structures comprising trichome fibers.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

In one example, the trichome fibers of the present invention are individualized from plants in the following families: Labiatae (Lamiaceae), Asteraceae, Scrophulariaceae, Greyiaceae, Fabaceae, Solanaceae, Convolvulaceae, Malvaceae, Loganiaceae, Rutaceae, Rhamnaceae, Geraniaceae, Melastomataceae, Bromeliaceae, Hypericaceae, Polygonaceae, Euphorbiaceae, Crassulaceae, Poaceae, Verbenaceae, and mixtures thereof.

In another example, the trichome fibers of the present invention are individualized from plants in the Labiatae (Lamiaceae) family, for example from one or more Stachys byzantina plants, more particularly, the *Stachys lanata* (commonly referred to as lamb's ear) plant.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

Natural fibrous structure-making fibers useful in the present invention include animal fibers, mineral fibers, other plant fibers (in addition to the trichomes of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Non-limiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Non-limiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); polylactic acids, polyhydroxyalkanoates, polycaprolactones, and mixtures thereof. In one example, synthetic fibers may be used as binding agents.

The web (fibrous structure) of the present invention may comprise fibers, films and/or foams that comprises a hydroxyl polymer and optionally a crosslinking system. Non-limiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Fibrous structures may be comprised of a combination of long fibers and short fibers.

Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

The individualized trichomes used in the present invention may include trichome fibers. The trichome fibers may be characterized as either long fibers or short fibers.

"Harvest" or "harvesting" as used herein means a process of gathering mature plants, for example by cutting and then collecting the plants, from a field, which may optionally include moving the plants to a processing operation or storage area.

"Stem" as used herein means a plant's axis that bears buds and shoots with leaves and, at its basal end, roots. In one example, the stem is the stalk of a plant.

"Sifting" as used herein means a process that separates and retains coarse parts with a sieve and/or screen allowing less coarse parts to pass through the sieve and/or screen.

"Fibrous structure" as used herein means a structure that comprises one or more fibers. Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Non-limiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density. "Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the Basis Weight Test Method described herein.

The sanitary tissue products of the present invention may exhibit a total dry tensile of at least 150 g/in and/or from about 200 g/in to about 1000 g/in and/or from about 250 g/in to about 850 g/in as measured according to the Tensile Test Method described herein.

In another example, the sanitary tissue product of the present invention may exhibit a total dry tensile of at least 300 g/in and/or at least 350 g/in and/or at least 400 g/in and/or at least 450 g/in and/or at least 500 g/in and/or from about 500 g/in to about 1000 g/in and/or from about 550 g/in to about 850 g/in and/or from about 600 g/in to about 800 g/in as measured according to the Tensile Test Method described herein. In one example, the sanitary tissue product exhibits a total dry tensile strength of less than 1000 g/in and/or less than 850 g/in as measured according to the Tensile Test Method described herein.

In another example, the sanitary tissue products of the present invention may exhibit a total dry tensile of at least 500 g/in and/or at least 600 g/in and/or at least 700 g/in and/or at least 800 g/in and/or at least 900 g/in and/or at least 1000 g/in and/or from about 800 g/in to about 5000 g/in and/or from about 900 g/in to about 3000 g/in and/or from about 900 g/in to about 2500 g/in and/or from about 1000 g/in to about 2000 g/in as measured according to the Tensile Test Method described herein.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Trichomes

Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures. Trichomes may have a wide range of morphology and chemical properties. For example, the trichomes may be in the form of fibers; namely, trichome fibers. Such trichome fibers may have a high length to diameter ratio.

The following sources are offered as non-limiting examples of trichome-bearing plants (suitable sources) for obtaining trichomes, especially trichome fibers.

Non-limiting examples of suitable sources for obtaining trichomes, especially trichome fibers, are plants in the Labiatae (Lamiaceae) family commonly referred to as the mint family.

Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the arcticus subspecies of *Thymus praecox*, commonly referred to as creeping thyme and the *pseudolanuginosus* subspecies of *Thymus praecox*, commonly referred to as wooly thyme.

Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable species in the Labiatae family include *Lavandula lanata*, commonly referred to as wooly lavender; *Marrubium vulgare*, commonly referred to as horehound; *Plectranthus argentatus*, commonly referred to as silver shield; and *Plectranthus tomentosa*.

Non-limiting examples of other suitable sources for obtaining trichomes, especially trichome fibers are plants in the Asteraceae family commonly referred to as the sunflower family.

Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow;

*Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii.*

Non-limiting examples of other suitable sources for obtaining trichomes, especially trichome fibers, are plants in the Scrophulariaceae family commonly referred to as the figwort or snapdragon family.

An example of a suitable species in the Scrophulariaceae family includes *Pedicularis kanei*, also known as the wooly lousewort.

Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and*Stemodia durantifolia.*

Non-limiting examples of other suitable sources for obtaining trichomes, especially trichome fibers include *Greyia radlkoferi* and *Greyia flanmaganii* plants in the Greyiaceae family commonly referred to as the wild bottlebrush family.

Non-limiting examples of other suitable sources for obtaining trichomes, especially trichome fibers include members of the Fabaceae (legume) family. These include the *Glycine max*, commonly referred to as the soybean, and *Trifolium pratense L*, commonly referred to as medium and/or mammoth red clover.

Non-limiting examples of other suitable sources for obtaining trichomes, especially trichome fibers include members of the Solanaceae family including varieties of *Lycopersicum esculentum*, otherwise known as the common tomato.

Non-limiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Non-limiting examples of other suitable sources for obtaining trichomes, especially trichome fibers include members of the Malvaceae (mallow) family, including *Anoda cristata*, commonly referred to as spurred anoda and *Abutilon theophrasti*, commonly referred to as velvetleaf.

Non-limiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of renardii in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa,* commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, Mass.

The trichome-bearing material may be subjected to a mechanical process to liberate its trichomes from its plant epidermis to enrich the pulp or fiber mass' content of individualized trichomes. This may be carried out by means of screening or air classifying equipment well known in the art. A suitable air classifier is the Hosokawa Alpine 50ATP, sold by Hosokawa Micron Powder Systems of Summit, N.J. Other suitable classifiers are available from the Minox Siebtechnik.

In one example, a trichome suitable for use in the fibrous structures of the present invention comprises cellulose.

In yet another example, a trichome suitable for use in the fibrous structures of the present invention comprises a fatty acid.

In still another example, a trichome suitable for use in the fibrous structures of the present invention is hydrophobic.

In yet another example, a trichome suitable for use in the fibrous structures of the present invention is less hydrophilic than softwood fibers. This characteristic of the trichome may facilitate a reduction in drying temperatures needed to dry fibrous structures comprising such trichome and/or may facilitate making the fibrous structures containing such trichome at a faster rate.

Figure 2:
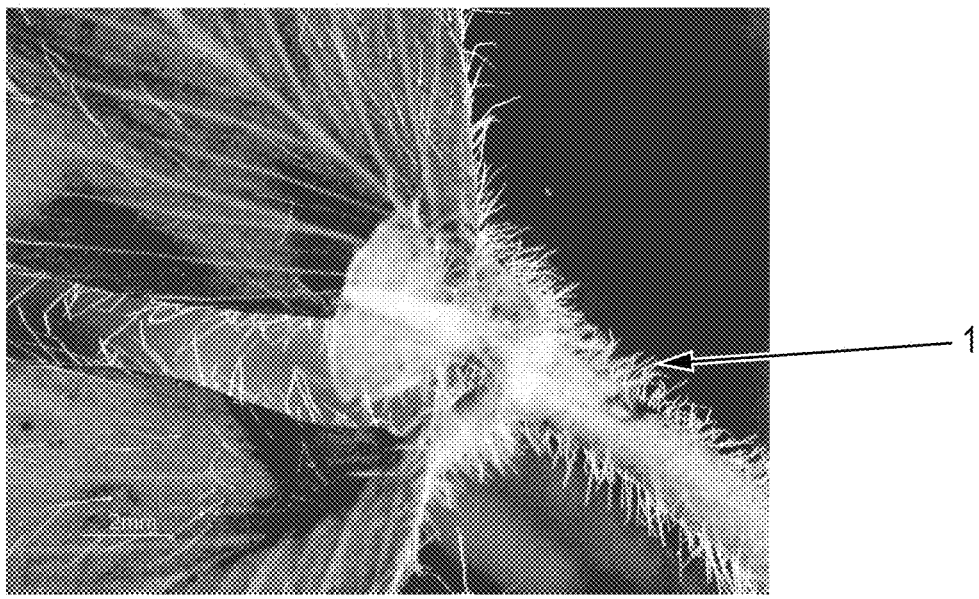
FIG. 2 is a light micrograph of a leaf and leaf stem illustrating trichome fibers present on red clover, *Trifolium pratense* L.
Figure 3:
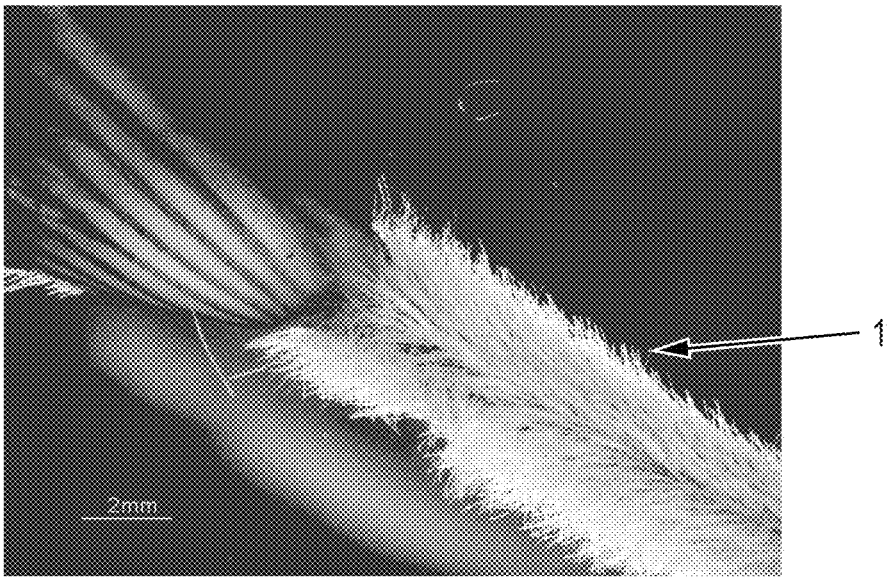
FIG. 3 is a light micrograph of a lower stem illustrating trichome fibers present on red clover, *Trifolium pratense* L.

As shown in FIG. 2, numerous trichome fibers 1 are present on this red clover leaf and leaf stem. FIG. 3 shows numerous trichome fibers 1 present on a red clover lower stem.

Figure 4:
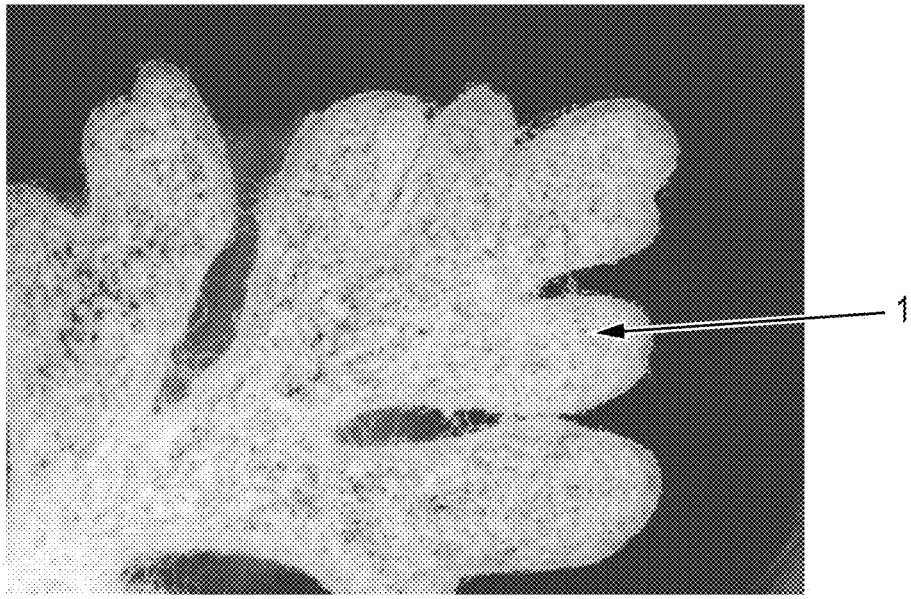
FIG. 4 is a light micrograph of a leaf illustrating trichome fibers present on dusty miller, *Centaurea gymnocarpa;*
Figure 5:
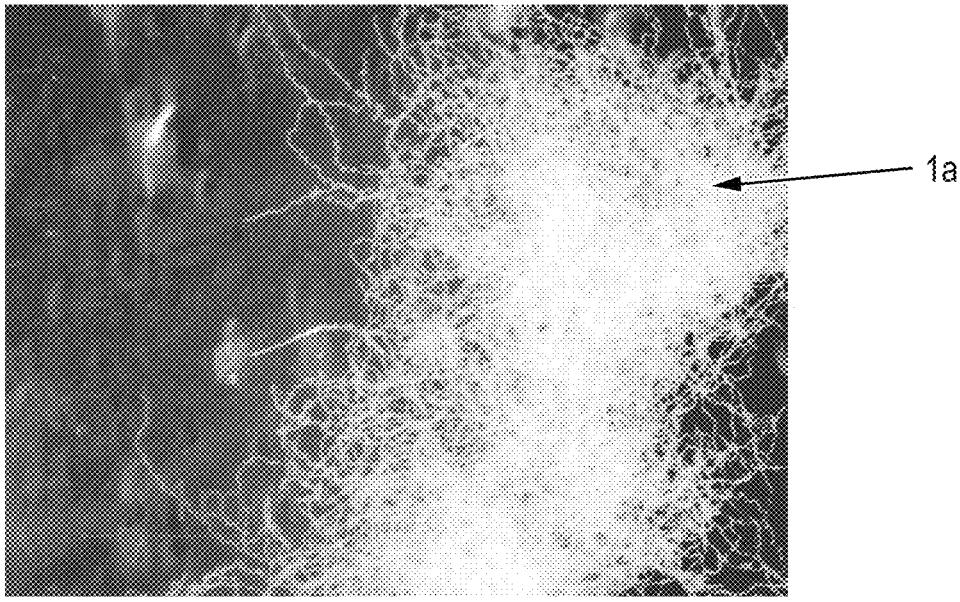
FIG. 5 is a light micrograph of individualized trichome fibers individualized from a leaf of dusty miller, *Centaurea gymnocarpa;*

As shown in FIG. 4, a dusty miller leaf is contains numerous trichome fibers 1. FIG. 5 shows individualized trichomes 1*a* obtained from a dusty miller leaf.

Figure 6:
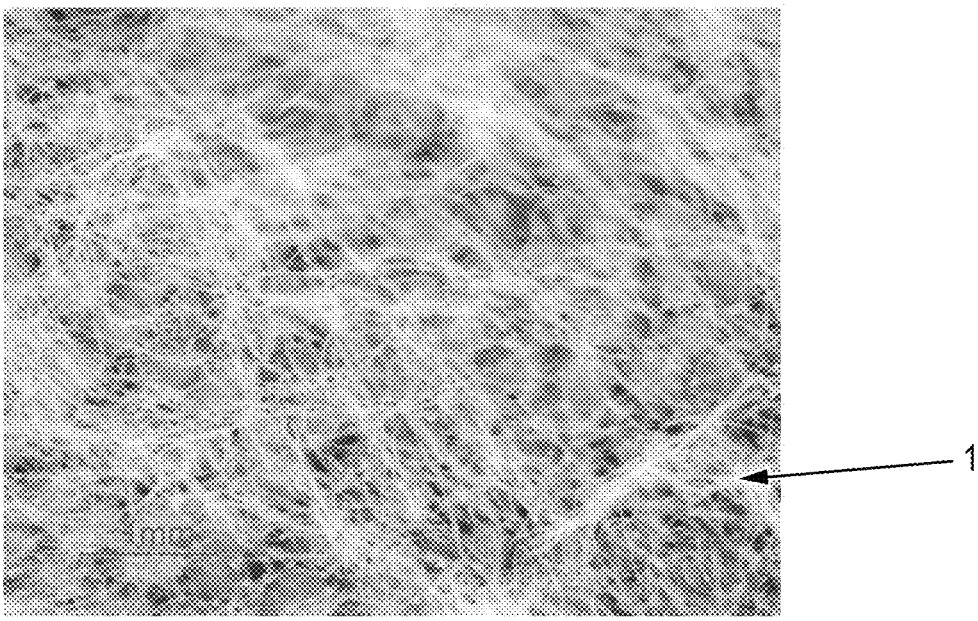
FIG. 6 is a light micrograph of a basal leaf illustrating trichome fibers present on silver sage, *Salvia argentiae;*
Figure 7:
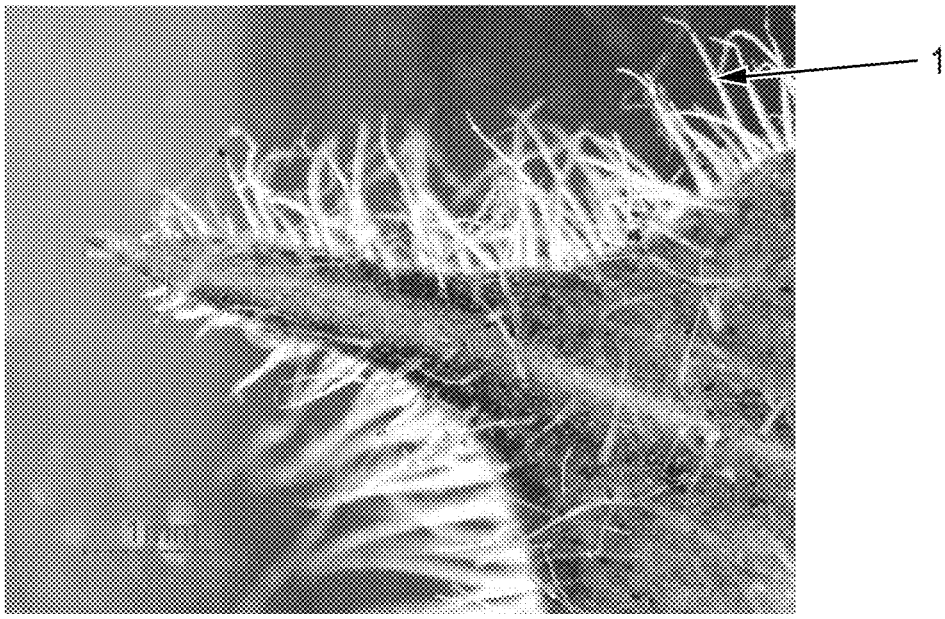
FIG. 7 is a light micrograph of a bloom-stalk leaf illustrating trichome fibers present in silver sage, *Salvia argentiae;*

As shown in FIG. 6, a basal leaf on a silver sage contains numerous trichomes 1. FIG. 7 shows trichome fibers 1 present on a bloom-stalk leaf of a silver sage.

Figure 8:
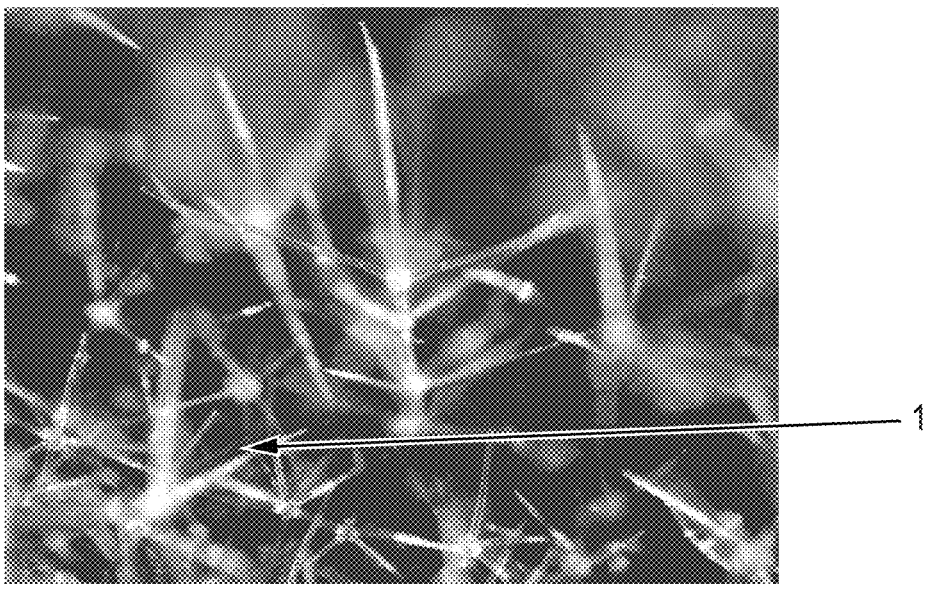
FIG. 8 is a light micrograph of a mature leaf illustrating trichome fibers present on common mullein, *Verbascum Thapsus;*
Figure 9:
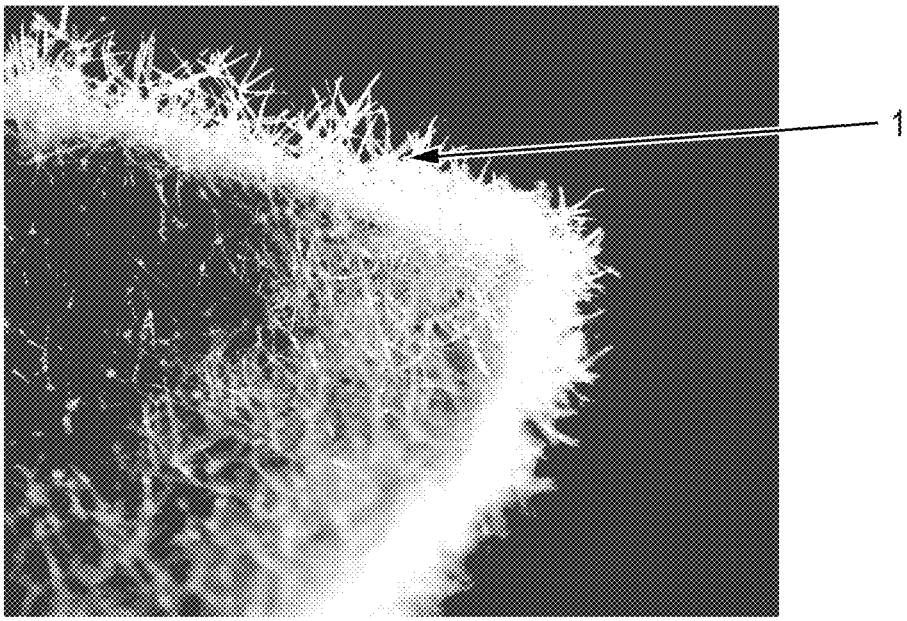
FIG. 9 is a light micrograph of a juvenile leaf illustrating trichome fibers present on common mullein, *Verbascum Thapsus;*

As shown in FIG. 8, trichome fibers 1 are present on a mature leaf of common mullein. FIG. 9 shows trichome fibers 1 present on a juvenile leaf of common mullein.

Figure 10:
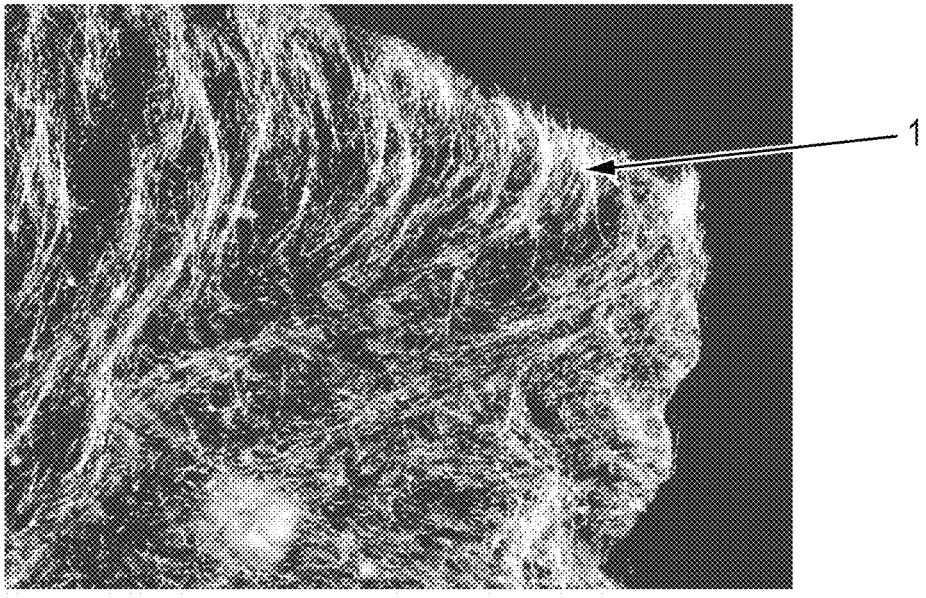
FIG. 10 is a light micrograph of a perpendicular view of a leaf illustrating trichome fibers present on wooly betony (lamb's ear), *Stachys byzantine;*
Figure 11:
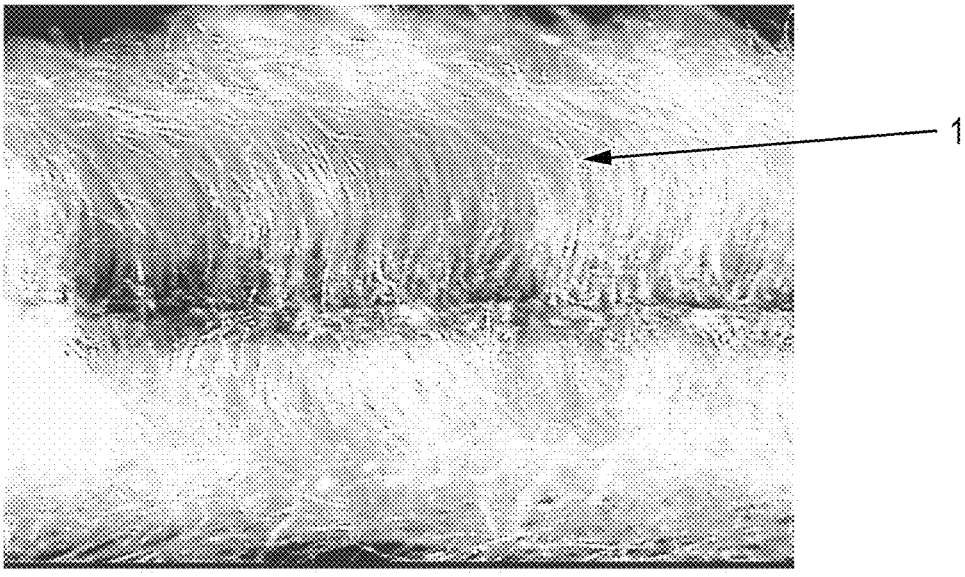
FIG. 11 is a light micrograph of a cross-sectional view of a leaf illustrating trichome fibers present on wooly betony (lamb's ear), *Stachys byzantine;*
Figure 12:
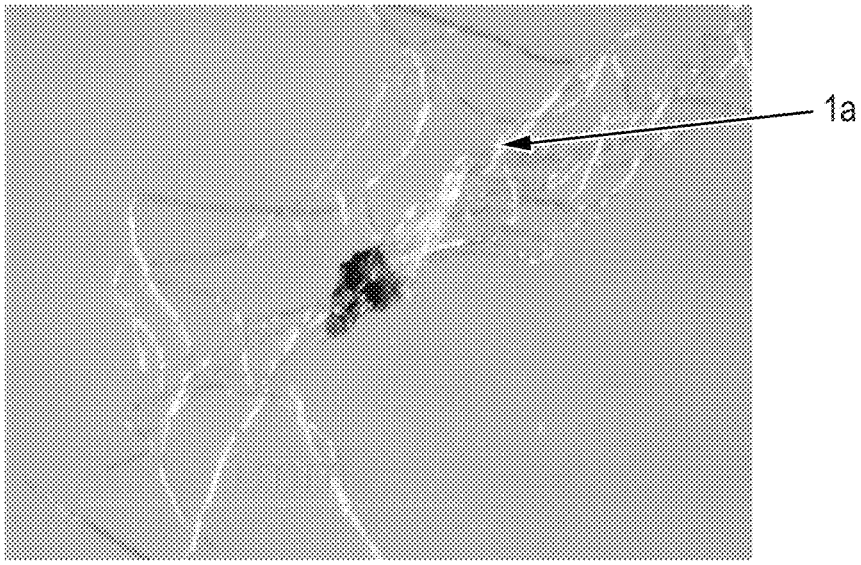
FIG. 12 is a light micrograph of individualized trichome fibers in the form of a plurality of trichome fibers bound by their individual attachment to a common remnant of a host plant, wooly betony (lamb's ear), *Stachys byzantine*.

FIG. 10 shows, via a perpendicular view, trichome fibers 1 present on a leaf of wooly betony (lamb's ear). FIG. 11 is a cross-sectional view of a leaf of wooly betony (lamb's ear) containing trichome fibers 1. FIG. 12 shows individualized trichome fibers 1*a* obtained from a wooly betony leaf (lamb's ear).

Fibrous Structures

The fibrous structures of the present invention may comprise greater than 50% and/or greater than 75% and/or greater than 90% and/or 100% or less by weight on a dry fiber basis of pulp fibers.

In one example, the fibrous structures of the present invention comprise less than 22% and/or less than 21% and/or less than 20% and/or less than 19% and/or less than 18% and/or to about 5% and/or to about 7% and/or to about 10% and/or to about 12% and/or to about 15% by weight on a dry fiber basis of softwood fibers.

In one example, the fibrous structures of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$ as measured according to the Basis Weight Test Method described herein.

In another example, the fibrous structures of the present invention may exhibit a basis weight of at least 21 $g/m^2$ and/or at least 23 $g/m^2$ and/or at least 25 $g/m^2$.

In yet another example, the fibrous structures of the present invention may comprise a plurality of pulp fibers, wherein greater than 0% but less than 20% by weight on a dry fiber basis of the pulp fibers are softwood fibers and wherein the fibrous structure comprises pulp fibers derived from a pulp fiber-producing source that has a growing cycle of less than 800 and/or every 400 and/or every 200 and/or every 100 or less days.

The fibrous structures of the present invention may comprise one or more individualized trichomes, especially trichome fibers. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may contain from about 0.1% to about 100% and/or from about 0.5% to about 90% and/or from about 0.5% to about 80% and/or from about 0.5% to about 50% and/or from about 1% to about 40% and/or from about 2% to about 30% and/or from about 5% to about 25% by weight on a dry fiber basis of trichome fibers. In one example, the fibrous structures of the present invention comprise at least 1% and/or at least 3.5% and/or at least 5% and/or at least 7.5% and/or at least 10% by weight on a dry fiber basis of trichome fibers.

In addition to a trichome, the fibrous structure may comprise other additives, such as wet strength additives, softening additives, solid additives (such as starch, clays), dry strength resins, wetting agents, lint resisting and/or reducing agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

The use of trichomes (trichome fibers) in the fibrous structure making process permits the reduction of softwood fibers in the fibrous structure. In one example, the inclusion of trichome fibers permits at least a 5% by weight on a dry fiber basis reduction of softwood fibers while maintaining a total dry tensile strength of greater than 500 g/in and/or greater than 520 g/in and increasing the softness (PSU) to at least 0.67 and/or at least 1.00.

In one example, the replacement of softwood fibers with trichome fibers produces a fibrous structure and/or sanitary tissue product that exhibits a softness (PSU) increase of at least 0.5 and/or at least 0.67 and/or at least 1.00 compared to the same fibrous structure and/or sanitary tissue product without the trichome fibers.

In addition to the reduction of softwood fibers, the inclusion of trichome fibers, may result, especially when they are added to an outer layer or in a homogeneous fibrous structure, in a surface that has a "fuzzy" feel to consumers. In addition, the trichome fibers may also provide surface smoothness increases, strength increases and flexibility increases to the fibrous structures.

Processes for Individualizing Trichomes from Plants

The processes of the present invention individualize (separate) trichomes from one or more trichome sources, such as plants, for example plants in one or more of the following families: Labiatae (Lamiaceae), Asteraceae, Scrophulariaceae, Greyiaceae, Fabaceae, Solanaceae, Convolvulaceae, Malvaceae, Loganiaceae, Rutaceae, Rhamnaceae, Geraniaceae, Melastomataceae, Bromeliaceae, Hypericaceae, Polygonaceae, Euphorbiaceae, Crassulaceae, Poaceae, Verbenaceae, and mixtures thereof. In one example, the trichome source is a plant from the Labiatae family, more particularly, the plant *Stachys byzantina*, for example *Stachys lanata*.

In one example, the process for individualizing a trichome fiber from a trichome source according to the present invention comprises the steps of:

a. contacting a trichome source with a chelating composition comprising a chelating agent and a surfactant to produce a soaked trichome source;
b. subjecting the soaked trichome source to a temperature of greater than 60° C.; and
c. removing one or more individualized trichome fibers from the soaked trichome source.

The step of contacting a trichome source may comprise contacting a plant and/or portions (stems and/or leaves or portions thereof) of a plant in one or more of the following families: Labiatae (Lamiaceae), Asteraceae, Scrophulariaceae, Greyiaceae, Fabaceae, Solanaceae, Convolvulaceae, Malvaceae, Loganiaceae, Rutaceae, Rhamnaceae, Geraniaceae, Melastomataceae, Bromeliaceae, Hypericaceae, Polygonaceae, Euphorbiaceae, Crassulaceae, Poaceae, Verbenaceae, and mixtures thereof with a chelating composition comprising a chelating agent and a surfactant to produce a soaked trichome. In one example, the trichome source that is soaked is a *Stachys byzantina* plant, for example a *Stachys lanata* plant (lamb's ear plant)

The chelating agent in the chelating composition may be selected from any suitable chelating agent capable of attacking the calcium-pectin bond in the trichome source. In one example, the chelating agent may be selected from the group consisting of: ethylenediaminetetraacetic acid (EDTA), ethylene glycol-bis(β-aminoethyl ether)-N,N,N',N'-tetraacetic acid (EGTA), nitriloacetic acid (NTA), N-(hydroxyethyl) ethylenediamine-N,N',N'-triaceetic acid (HEDTA), diethylenetriaminepentaacetic acid (DTPA), polyphosporic acid, and mixtures thereof. In one example, the chelating agent comprises EDTA and/or EGTA.

The surfactant in the chelating composition may be selected from any suitable surfactant, such as nonionic, anionic, cationic, zwitterionic, amphoteric, and mixtures thereof. In one example, the surfactant comprises a nonionic surfactant.

Non-limiting examples of suitable nonionic surfactants include alkoxylated alcohols (AE's) and alkyl phenols, polyhydroxy fatty acid amides (PFAA's), alkyl polyglycosides (APG's), $C_{10}$-$C_{18}$ glycerol ethers, and the like.

In one example, non-limiting examples of nonionic surfactants useful in the present invention include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. No. 6,153,577, U.S. Pat. No. 6,020,303 and U.S. Pat. No. 6,093,856; alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; polyhydroxy detergent acid amides as discussed in U.S. Pat. No. 5,332,528; and ether capped poly(oxyalkylated) alcohol surfactants as discussed in U.S. Pat. No. 6,482,994 and WO 01/42408.

Examples of commercially available nonionic surfactants suitable for the present invention include: Tergitol® 15-S-9 (the condensation product of $C_{11}$-$C_{15}$ linear alcohol with 9 moles ethylene oxide) and Tergitol® 24-L-6 NMW (the condensation product of $C_{12}$-$C_{14}$ primary alcohol with 6 moles ethylene oxide with a narrow molecular weight distribution), both marketed by Dow Chemical Company; Neodol® 45-9 (the condensation product of $C_{14}$-$C_{15}$ linear alcohol with 9 moles of ethylene oxide), Neodol® 23-3 (the condensation product of $C_{12}$-$C_{13}$ linear alcohol with 3 moles of ethylene oxide), Neodol® 45-7 (the condensation product of $C_{14}$-$C_{15}$ linear alcohol with 7 moles of ethylene oxide) and Neodol® 45-5 (the condensation product of $C_{14}$-$C_{15}$ linear alcohol with 5 moles of ethylene oxide) marketed by Shell Chemical Company; Kyro® EOB (the condensation product of $C_{13}$-$C_{15}$ alcohol with 9 moles ethylene oxide), marketed by The Procter & Gamble Company; and Genapol LA O3O or O5O (the condensation product of $C_{12}$-$C_{14}$ alcohol with 3 or 5 moles of ethylene oxide) marketed by Hoechst. The nonionic surfactants may exhibit an HLB range of from about 8 to about 17 and/or from about 8 to about 14. Condensates with propylene oxide and/or butylene oxides may also be used.

Non-limiting examples of suitable anionic surfactants include alkyl sulfates, alkyl ether sulfates, branched alkyl sulfates, branched alkyl alkoxylates, branched alkyl alkoxylate sulfates, mid-chain branched alkyl aryl sulfonates, sulfated monoglycerides, sulfonated olefins, alkyl aryl sulfonates, primary or secondary alkane sulfonates, alkyl sulfosuccinates, acyl taurates, acyl isethionates, alkyl glycerylether sulfonate, sulfonated methyl esters, sulfonated fatty acids, alkyl phosphates, acyl glutamates, acyl sarcosinates, alkyl sulfoacetates, acylated peptides, alkyl ether carboxylates, acyl lactylates, anionic fluorosurfactants, sodium lauroyl glutamate, and combinations thereof.

Non-limiting examples of suitable cationic surfactants include, but are not limited to, those having the formula (I):

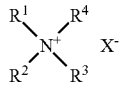

I in which $R^1$, $R^2$, $R^3$, and $R^4$ are each independently selected from (a) an aliphatic group of from 1 to 26 carbon atoms, or (b) an aromatic, alkoxy, polyoxyalkylene, alkylamido, hydroxyalkyl, aryl or alkylaryl group having up to 22 carbon atoms; and X is a salt-forming anion such as those selected from halogen, (e.g. chloride, bromide), acetate, citrate, lactate, glycolate, phosphate, nitrate, sulphate, and alkylsulphate radicals. In one example, the alkylsulphate radical is methosulfate and/or ethosulfate.

Non-limiting examples of zwitterionic or ampholytic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$ and in certain embodiments from $C_{10}$ to $C_{14}$.

Non-limiting examples of amphoteric surfactants include: aliphatic derivatives of secondary or tertiary amines, or aliphatic derivatives of heterocyclic secondary and tertiary amines in which the aliphatic radical can be straight- or branched-chain and mixtures thereof. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of amphoteric surfactants.

The chelating composition may comprise from about 1% to about 10% and/or from about 2% to about 8% and/or from about 2% to about 6% and/or from about 3% to about 5% by weight of one or more chelating agents.

The chelating composition may comprise from about 0.01% to about 5% and/or from about 0.05% to about 3% and/or from about 0.1% to about 2% and/or from about 0.5% to about 1% by weight of one or more surfactants.

The chelating composition may comprise from about 1% to about 10% and/or from about 2% to about 8% and/or from about 2% to about 6% and/or from about 3% to about 5% by weight of one or more chelating agents and from about 0.01% to about 5% and/or from about 0.05% to about 3% and/or from about 0.1% to about 2% and/or from about 0.5% to about 1% by weight of one or more surfactants.

The chelating composition may comprise one or more buffering agents to buffer the chelating composition to a desired pH.

Further, the chelating composition may comprise water up to about 99% by weight of the chelating composition.

The chelating composition of the present invention may exhibit a pH of greater than 4 and/or less than 11 and/or greater than 6 and/or less than 10 and/or from about 7 to about 9.

In one example, the individualized trichome fibers are substantially free of (less than 5% and/or less than 4% and/or less than 3% and/or less than 2% and/or less than 1% and/or less than 0.5% and/or about 0% by weight of non-trichome materials) non-trichome materials, especially non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Trichomes Purity Test Method.

Figure 13:
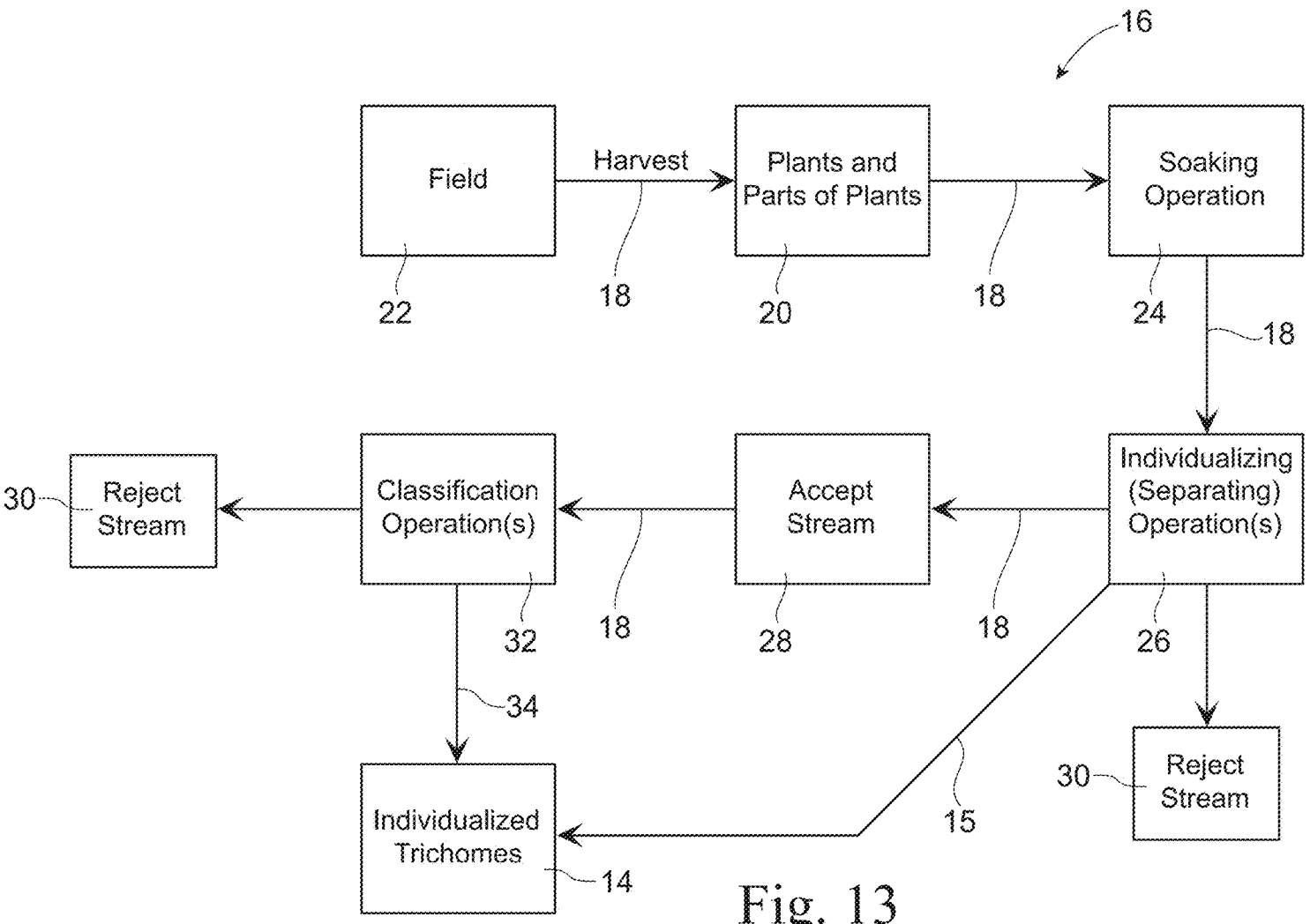
FIG. 13 is a flow chart illustrating an example of a process according to the present invention.

As shown in FIG. 13, examples of a process 16 for individualizing trichomes from a trichome source 18 according to the present invention comprises the steps of:

a. providing a trichome source 18, for example plants and/or parts of plants, for example harvested from a field 22, wherein the trichome source 18 comprises a mixture of trichome fibers and non-trichome materials;
b. soaking the trichome source 18 in a chelating composition comprising a chelating agent and a surfactant;
c. subjecting the soaked trichome source 18 to a temperature of greater than 60° C.; and
d. separating, for example by subjecting the soaked trichome source 18 to a shear mixer, the trichome fibers from the trichome source 18 to produce individualized trichomes 14. In one example, the individualized trichomes 14 are substantially free of non-trichome materials having an average particle size of 0.0001 $cm^2$ or greater as measured according to the Trichomes Purity Test Method.

The trichome source 18, as shown in FIG. 13, may be obtained from a plant and/or parts of a plant 20, such as a trichome-bearing plant. In one example, the process further comprises the step of harvesting the plant, for example from a field 22. In one example, the plant may be in the *Stachys* genus, for example the plant may be *Stachys byzantina* or otherwise known as "Lamb's Ear." In another example, the plant may be any trichome-bearing plant, for example any plants that bear the trichomes described herein.

As shown in FIG. 13, the process of the present invention may further comprise the step of: subjecting the plant, for example trichome-bearing plant, to one or more soaking operations 24 by soaking the trichome source 18 in a chelating composition comprising one or more chelating agents and one or more surfactants.

The process for individualizing 16, as shown in FIG. 13, may further comprise the step of: subjecting the soaked trichome source 18 to mechanical energy, for example a shear mixer (blender or homogenizer), to individualize (separate) the trichomes 14 from the trichome source 18 in one or more individualizing (separating) operations 26. In one example, the shear mixer is operated at from about 1 to about 300 and/or from about 1 to about 200 and/or from about 3 to about 150 and/or from about 3 to about 100 rpm. In one example, this step breaks the trichome source 18 material into pieces that are at least 8× and/or at least 10× smaller in size than the individualized trichomes 14. In one example, the individualizing (separating) step 26 comprises the step of passing the resulting mixture from the individualizing (separating) operation through a sieve, for example a 125 μm, to produce remove the non-trichome materials (pieces of trichome source 18 described above) and retain the individualized trichomes 14 on the sieve thus resulting in a stream 15 of individualized trichomes 14 and/or an accept stream 28 (comprising a mixture of individualized trichomes 14 and a minor non-trichome materials) and a reject stream 30 (entirely or primarily non-trichome materials, for example the pieces of trichome source 18 that pass through the sieve). The reject stream 30 that can be discarded or recycled. The individualizing (separating) operation 26 may further comprise the step of removing the chelating agent(s) and surfactant(s), such as by rinsing the individualized trichomes 14.

The process for individualizing trichomes 16, as shown in FIG. 13, may further comprise the step of: subjecting the accept stream 28 from the individualizing (separating) operation 26 to one or more classification operations 32 to classify the accept stream 28 based on size to produce a classified stream 34 comprising individualized trichomes 14 that are substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Trichomes Purity Test Method and a reject stream 30 comprising primarily non-trichome materials. In one example, the step of subjecting the accept stream 28 to one or more classification operations 32 comprises the step of passing the accept stream 28 through an air classifier. In another example, the step of subjecting the accept stream 28 to one or more classification operations 32 comprises the step of passing the accept stream 28 through a hydrocyclone. In one example, the trichomes and non-trichome materials are separated based on density. In one example, the trichomes are less dense than the non-trichome materials. In still another example, the step of subjecting the accept stream 28 to one or more classification operations 32 comprises the step of passing the accept stream 28 through a screen, such as a pressure screen, such as a slotted pressure screen. In one example, the screen is a center screen, for example a slotted center pressure screen. The slotted screen may comprise slots that are sized to permit trichomes to pass through the slots. In one example, the slots have a minimal dimension of less than 0.004 mm and/or less than 0.003 mm and/or less than 0.0025 mm and/or less than 0.002 mm and/or greater than 0.0017 mm and/or at least 0.0018 mm. In one example, the screen is a pressure screen, for example a slotted, center pressure screen available from Kadant Black Clawson of Mason, Ohio. In one example, the slotted screen comprises slots that have a maximum dimension of less than 30 μm and/or less than 25 μm.

The process for individualizing trichomes 16, as shown in FIG. 13, may further comprise contacting the accept stream 28 with moisture, such as water, for example by spraying water onto the accept stream 28.

In another example, the process for individualizing trichomes 16, as shown in FIG. 13, may further comprise the step of contacting the classified stream 34 with moisture, such as water, for example by spraying water onto the classified stream 34.

In one example, the individualized trichomes 14 (the "purified" trichomes) may be washed and filtered to form a filter cake and then analyzed to determine the total surface area provided by the total non-trichome materials present, if any, in the individualized trichomes 14. In one example, the total non-trichome materials present in the individualized trichomes 14 exhibit a total surface area of less than 0.2% and/or less than 0.15% and/or less than 0.1% and/or less than 0.05% and/or less than 0.025% and/or less than 0.0245% as measured according to the Trichomes Purity Test Method.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. All tests are conducted in such conditioned room. Do not test samples that have defects such as wrinkles, tears, holes, and like.

Tensile Test Method: Peak Elongation, Tensile Strength, TEA and Modulus

Peak Elongation, Tensile Strength, TEA and Tangent Modulus are measured on a constant rate of extension tensile tester with computer interface (a suitable instrument is the EJA Vantage from the Thwing-Albert Instrument Co. Wet Berlin, N.J.) using a load cell for which the forces measured are within 10% to 90% of the limit of the cell. Both the movable (upper) and stationary (lower) pneumatic jaws are fitted with smooth stainless steel faced grips, 25.4 mm in height and wider than the width of the test specimen. An air pressure of about 60 psi is supplied to the jaws.

Eight usable units of a fibrous structure and/or sanitary tissue product sample are divided into two stacks of four samples each. The samples in each stack are consistently oriented with respect to machine direction (MD) and cross direction (CD). One of the stacks is designated for testing in the MD and the other for CD. Using a one inch precision cutter (Thwing Albert JDC-1-10, or similar) cut 4 MD strips from one stack, and 4 CD strips from the other, with dimensions of 1.00 in±0.01 in wide by 3.0-4.0 in long. Each strip of one usable unit thick will be treated as a unitary specimen for testing.

Program the tensile tester to perform an extension test, collecting force and extension data at an acquisition rate of 20 Hz as the crosshead raises at a rate of 2.00 in/min (5.08 cm/min) until the specimen breaks. The break sensitivity is set to 80%, i.e., the test is terminated when the measured force drops to 20% of the maximum peak force, after which the crosshead is returned to its original position.

Set the gauge length to 1.00 inch. Zero the crosshead and load cell. Insert at least 1.0 in of the unitary specimen into the upper grip, aligning it vertically within the upper and lower jaws and close the upper grips. Insert the unitary specimen into the lower grips and close. The unitary specimen should be under enough tension to eliminate any slack, but less than 5.0 g of force on the load cell. Start the tensile tester and data collection. Repeat testing in like fashion for all four CD and four MD unitary specimens.

Program the software to calculate the following from the constructed force (g) verses extension (in) curve:

Tensile Strength is the maximum peak force (g) divided by the sample width (in) and reported as g/in to the nearest 1 g/in.

Adjusted Gauge Length is calculated as the extension measured at 3.0 g of force (in) added to the original gauge length (in).

Peak Elongation is calculated as the extension at maximum peak force (in) divided by the Adjusted Gauge Length (in) multiplied by 100 and reported as % to the nearest 0.1%

Total Energy (TEA) is calculated as the area under the force curve integrated from zero extension to the extension at the maximum peak force (g*in), divided by the product of the adjusted Gauge Length (in) and specimen width (in) and is reported out to the nearest 1 g*in/in$^2$. Replot the force (g) verses extension (in) curve as a force (g) verses strain curve. Strain is herein defined as the extension (in) divided by the Adjusted Gauge Length (in).

Program the software to calculate the following from the constructed force (g) verses strain curve:

Tangent Modulus (Modulus) is the Modulus at 15 g/cm.

The Tensile Strength (g/in), Peak Elongation (%), Total Energy (g*in/in$^2$) and Modulus (g/cm), which is the Tangent Modulus at 15 g/cm), are calculated for the four CD unitary specimens and the four MD unitary specimens. Calculate an average for each parameter separately for the CD and MD specimens.

Calculations:

Geometric Mean Tensile Strength=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA (g*in/in2)×CD TEA (g*in/in2)]

Geometric Mean Modulus=Square Root of [MD Modulus (g/cm) (at 15 g/cm)×CD Modulus (g/cm) (at 15 g/cm)]

Total Dry Tensile Strength (TDT)=MD Tensile Strength (g/in)+CD Tensile Strength (g/in)

Total TEA=MD TEA (g*in/in2)+CD TEA (g*in/in2)

Total Modulus=MD Modulus (g/cm)+CD Modulus (g/cm)

Tensile Ratio=MD Tensile Strength (g/in)/CD Tensile Strength (g/in)

Initial Total Wet Tensile Test Method

The initial total wet tensile of a dry fibrous structure is determined using a Thwing-Albert EJA Material Tester Instrument, Cat. No. 1350, equipped with 5000 g load cell available from Thwing-Albert Instrument Company, 14 Collings Ave. W. Berlin, N.J. 08091. 10% of the 5000 g load cell is utilized for the initial total wet tensile test.

i. Sample Preparation—A sample strip of dry fibrous structure to be tested [2.54 cm (1 inch) wide by greater than 5.08 cm (2inches)] long is obtained.

ii. Operation—The test settings for the instrument are:
   Crosshead speed—10.16 cm/minute (4.0 inches/minute)
   Initial gauge length 2.54 cm (1.0 inch)
   Adjust the load cell to read zero plus or minus 0.5 grams$_{force}$ ($g_f$)

iii. Testing Samples—One end of the sample strip is placed between the upper jaws of the machine and clamped. After verifying that the sample strip is hanging straight between the lower jaws, clamp the other end of the sample strip in the lower jaws.

a. Pre-Test—Strain the sample strip to 25 grams$_{force}$ (+/−10 grams$_{force}$) at a strain rate of 3.38 cm/minute (1.33 inches/minute) prior to wetting the sample strip. The distance between the upper and lower jaws now being greater than 2.54 cm (1.0 inch). This distance now becomes the new zerostrain position for the forthcoming wet test described below.

b. Wet Test—While the sample strip is still at 25 grams$_{force}$ (+/−10 grams$_{force}$), it is wetted, starting near the upper jaws, a water/0.1% Pegosperse® ML200 (available from Lonza Inc. of Allendale, N.J.) solution [having a temperature of about 73° F.±4° F. (about 23° C.±2.2° C.)] is delivered to the sample strip via a 2 mL disposable pipette. Do not contact the sample strip with the pipette and do not damage the sample strip by using excessive squirting pressure. The solution is continuously added until the sample strip is visually determined to be completely saturated between the upper and lower jaws. At this point, the load cell is re-adjusted to read 0±0.5 $grams_{force}$. The sample strip is then strained at a rate of 10.16 cm/minute (4 inches/minute) and continues until the sample strip is strained past its failure point (failure point being defined as the point on the force-strain curve where the sample strip falls to 50% of its peak strength after it has been strained past its peak strength). The straining of the sample strip is initiated between 5-10 seconds after the sample is initially wetted. The initial result of the test is an array of data points in the form of load ($grams_{force}$) versus strain (where strain is calculated as the crosshead displacement (cm of jaw movement from starting point) divided by the initial separation distance (cm) between the upper and lower jaws after the pre-test.

The sample is tested in two orientations, referred to here as MD (machine direction, i.e., in the same direction as the continuously wound reel and forming fabric) and CD (cross-machine direction, i.e., 90° from MD). The MD and CD initial wet tensile strengths are determined using the above equipment and the initial total wet tensile values are calculated in the following manner:

$$ITWT(g/\text{inch})=\text{Peak Load}_{MD}(g_f)/1\ (\text{inch}_{width})+\text{Peak Load}_{CD}\ (g_f)/1\ (\text{inch}_{width})$$

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

$$\text{Basis Weight}=(\text{Mass of stack})/[(\text{Area of 1 square in stack})\times(\text{No. of squares in stack})]$$

For example, $$\text{Basis Weight (lbs/3000 ft}^2)=[[\text{Mass of stack } (g)/453.6\ (g/\text{lbs})]/[12.25\ (\text{in}^2)/144\ (\text{in}^2/\text{ft}^2)\times 12]]\times 3000$$

or, $$\text{Basis Weight } (g/\text{m}^2)=\text{Mass of stack } (g)/[79.032\ (\text{cm}^2)/10{,}000\ (\text{cm}^2/\text{m}^2)\times 12]$$

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Trichomes Purity Test Method

To determine the purity (lack of non-trichome materials) of the extracted trichomes, filter cakes of the extracted trichomes are formed.

Filter cakes of the extracted trichomes are made by washing the extracted trichomes in water with a liquid dishwashing detergent, for example Dawn® from The Procter & Gamble Company, and using a hand held kitchen homogenizer to completely disperse the extracted trichomes in the wash water. The wash water with the extracted trichomes is then filtered through a Büchner funnel, and washed with water and acetone and then allowed to dry on the filter paper, for example to a moisture level of less than 10% moisture, before taking images of the filter cakes.

Images of a filter cake to be analyzed is then taken using a typical flatbed scanner set at 600 dpi. ImageJ software, a free program developed by the National Institute of Health, is used to analyze the images and to count the non-trichome materials (particles) per square cm of the filter cake. The ImageJ software program is also used to calculate the total area of the non-trichome materials (particles) of the filter cake, the percent non-trichome materials (particles) of the total area, and the average particle size of the non-trichome materials in the filter cake.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for individualizing a trichome fiber from a trichome source, wherein the process comprises the steps of:

a. contacting a trichome source with a chelating composition comprising a chelating agent and a surfactant to produce a soaked trichome source;

b. subjecting the soaked trichome source to a temperature of greater than 60° C.; and c. removing one or more individualized trichome fibers from the soaked trichome source.

2. The process according to claim 1 wherein the trichome source is selected from the group consisting of: leaves, stems, and mixtures thereof.

3. The process according to claim 1 wherein the chelating composition is present at a level such that the trichome source is saturated.

4. The process according to claim 1 wherein the chelating agent is selected from the group consisting of: ethylenediaminetetraacetic acid, ethylene glycol-bis(β-aminoethyl ether)-N,N,N',N'-tetraacetic acid, nitriloacetic acid, N-(hydroxyethyl)ethylenediamine-N,N',N'-triacetic acid, diethylenetriaminepentaacetic acid, polyphosporic acid, and mixtures thereof.

5. The process according to claim 4 wherein the chelating agent comprises ethylenediaminetetraacetic acid.

6. The process according to claim 4 wherein the chelating agent comprises ethylene glycol-bis(β-aminoethyl ether)-N,N,N',N'-tetraacetic acid.

7. The process according to claim 1 wherein the surfactant is selected from the group consisting of: nonionic, anionic, cationic, zwitterionic, amphoteric, and mixtures thereof.

8. The process according to claim 7 wherein the nonionic surfactant comprises an alkoxylated alcohol surfactant.

9. The process according to claim 1 wherein the chelating composition comprises from about 1% to about 10% by weight of the chelating agent and from about 0.01% to about 5% by weight of the surfactant.

10. The process according to claim 1 wherein the chelating composition exhibits a pH of greater than 4.

11. The process according to claim 1 wherein the chelating composition exhibits a pH of less than 11.

12. The process according to claim 1 wherein the chelating composition exhibits a pH of greater than 4 but less than 11.

13. The process according to claim 1 wherein the trichome source is contacted with the chelating composition for at least 1 minute.

14. The process according to claim 13 wherein the trichome source is contacted with the chelating composition for at least 5 minutes.

15. The process according to claim 1 wherein the soaked trichome source is subjected to the temperature of greater than 60° C. for at least 5 minutes.

16. The process according to claim 15 wherein the soaked trichome source is subjected to the temperature of greater than 60° C. for at least 10 minutes.

17. The process according to claim 16 wherein the soaked trichome source is subjected to the temperature of greater than 60° C. for at least 15 minutes.

18. The process according to claim 1 wherein the step of removing one or more individualized trichomes from the soaked trichome source comprises the step of:

d. subjecting the soaked trichome source to a shear mixer to break the trichome source into a plurality of pieces.

19. The process according to claim 18 wherein the shear mixer is operated at a speed of from about 1 to about 300 rpm.

* * * * *